United States Patent [19]

Röck et al.

[11] Patent Number: 4,705,328

[45] Date of Patent: Nov. 10, 1987

[54] MOUNTING DEVICE FOR FRONT MEMBERS OF DRAWERS

[75] Inventors: Erich Röck, Höchst; Helmut Hollenstein, Lustenau, both of Austria

[73] Assignee: Julius Blum Gesellschaft m.b.H., Höchst, Austria

[21] Appl. No.: 877,789

[22] Filed: Jun. 24, 1986

[30] Foreign Application Priority Data

Jun. 25, 1985 [AT] Austria ..... 1878/85

[51] Int. Cl.[4] ..... A47B 88/00

[52] U.S. Cl. ..... 312/330 R; 312/263

[58] Field of Search ..... 312/330 R, 263, 257 R, 312/257 A, 257 SM, 330 SM

[56] References Cited

U.S. PATENT DOCUMENTS

| | | | |
|---|---|---|---|
| 4,090,753 | 5/1978 | Rock et al. | 312/330 R X |
| 4,230,382 | 10/1980 | Wenzlick et al. | 312/330 R |
| 4,458,965 | 7/1984 | Ohlendorf et al. | 312/330 R |
| 4,579,402 | 4/1986 | Wenzlick et al. | 312/330 R |
| 4,589,710 | 5/1986 | Rock et al. | 312/330 R |
| 4,595,245 | 6/1986 | Rock et al. | 312/330 R |

FOREIGN PATENT DOCUMENTS

| | | | |
|---|---|---|---|
| 30290 | 6/1981 | European Pat. Off. | 312/330 R |
| 2321876 | 11/1973 | Fed. Rep. of Germany | 312/330 R |
| 3120555 | 6/1982 | Fed. Rep. of Germany | 312/330 R |
| 3135788 | 8/1982 | Fed. Rep. of Germany | 312/330 R |
| 3120840 | 9/1982 | Fed. Rep. of Germany | 312/330 R |
| 3213984 | 10/1983 | Fed. Rep. of Germany | 312/330 R |

*Primary Examiner*—Kenneth J. Dorner
*Assistant Examiner*—Thomas A. Rendos
*Attorney, Agent, or Firm*—Wenderoth, Lind & Ponack

[57] ABSTRACT

A device for mounting a front member to a drawer includes a holding element fastenable to the front member and a supporting element fastenable to a side wall of the drawer. The supporting element includes a fastening element and a hook member which is adjustably mounted thereon and which the holding element is engageable. A clamping screw engages the hook member and causes the front member to be locked. A side adjustment screw achieves positional adjustment laterally, and an eccentric carries out vertical adjustment of the front member.

10 Claims, 5 Drawing Figures

MOUNTING DEVICE FOR FRONT MEMBERS OF DRAWERS

FIELD AND BACKGROUND OF THE INVENTION

The invention relates to a mounting device for front panels or members of drawers, and comprising a holding element fastened to the front member and a supporting means fastened to the drawer, the supporting means having adjustment means for the vertical and lateral adjustment of the front member relative to the drawer as well as a fixed fastening element and an adjustably mounted supporting element carrying the holding element.

It is a function of a mounting device for front members of the above-mentioned kind to hold the front member adjustably at the drawer so that, when the piece of furniture is assembled, the position of the front member can be adjusted in such a manner that all drawers have equal joints therebetween. Furthermore, the mounting device for the front member should allow quick and secure mounting of the front member to the drawer.

SUMMARY OF THE INVENTION

It is the object of the invention to provide an improved mounting device for front members of the aforementioned kind. The mounting device for front members according to the present invention should in particular allow easy adjustment of the front member in directions toward the side and of the height of the piece of furniture.

According to the invention this is achieved in that the supporting element into which the holding element is engaged is a hook member rotatable about a horizontal axis and extending generally perpendicularly to the front member, and a clamping screw or the like by means of which the hook member is movable perpendicularly to the front member to thereby clamp or lock the front member.

It is advantageously provided that the hook member projects into a vertical slot in the holding element and engages therein with a bolt or rod, the hook member being snugly received in the holding element. It is further advantageously provided that a side adjustment screw which is horizontally and parallelly aligned to the front member engages the hook member and abuts the fastening element. This arrangement allows a simple lateral adjustment of the front member.

The complete mounting device for the front member is advantageously arranged between double panel side walls of the drawer, the inner wall having perforations which allow access of adjustment tools to the mounting device for the front member.

When the walls are made of metal, the supporting element is advantageously held at the walls by means of point welding.

To improve the fit of the mounted front member at the mounting device, a preferred embodiment provides that the hook member has an undercut recess in the region of the bolt.

A further embodiment provides an eccentric mounted on the hook member and abutting a horizontal flange of the fastening element. The eccentric serves for the vertical adjustment of the hook member and, hence, of the front member and is advantageously arranged between the side adjustment screw and the clamping screw.

Clamping of the hook member and, hence, of the front member is advantageously achieved in that the clamping screw, which is mounted in a female thread of the hook member, has a countersunk head one side of which abuts against the rim of a hole in the fastening element, the fastening element having flaps or flanges which advantageously extend parallel to the front member and with which the holding element abuts.

BRIEF DESCRIPTION OF THE FIGURES OF THE DRAWINGS

Below an embodiment of the invention will be described in more detail with reference to the accompanying drawings in which.

DESCRIPTION OF THE PREFERRED EMBODIMENT

Figure 1:
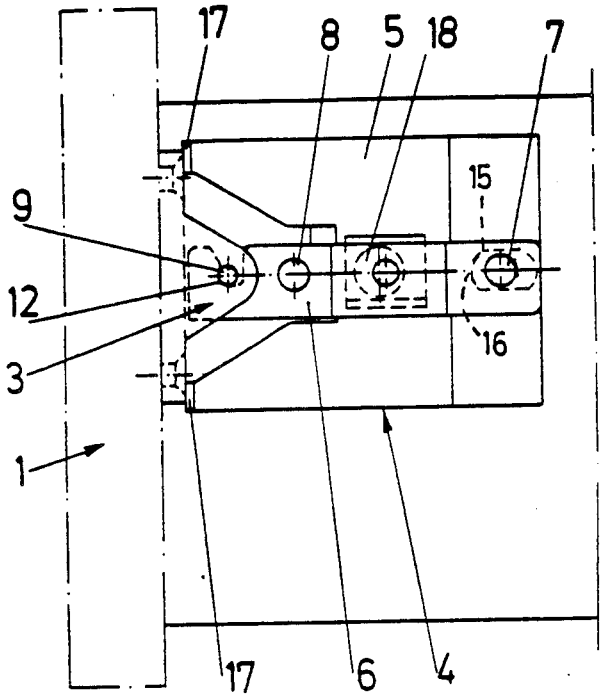
FIG. 1 is a schematic side view of a mounting device for front members according to the invention.

In the drawings reference number 1 shows a front member, and reference number 2 shows a double side wall.

The essential parts of the mounting device for the front member are a holding element 3 fastened to the front member 1 and a supporting means 4 fastened to the drawer side wall 2.

Supporting means 4 includes a hook member 6 mounted on a fastening element 5 by means of a clamping screw 7 and a side adjustment screw 8.

Figure 3:
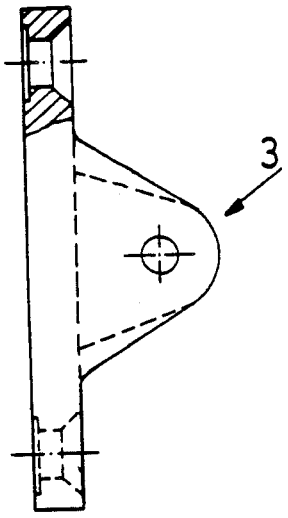
FIG. 3 is a side view of a holding element thereof.
Figure 4:
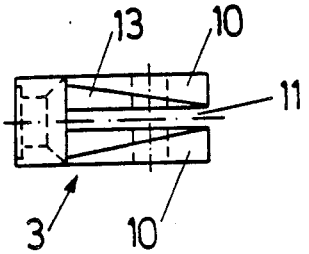
FIG. 4 is a top view of the holding element.
Figure 5:
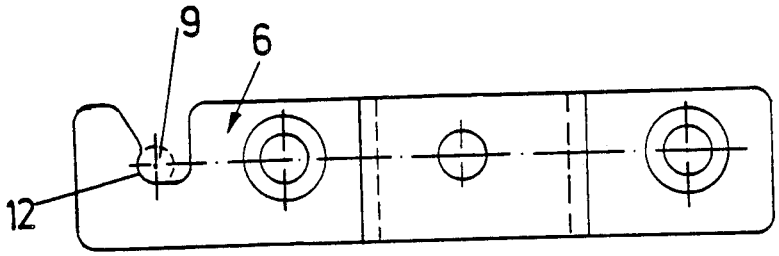
FIG. 5 is a side view of a member hook.

The holding element 3 has a bolt 9 engaged by the hook member 6. As can be seen from FIGS. 3 and 4, the holding element 3 is symmetrical and comprises two projections or cheeks 10 with a slot 11 being formed therebetween through which extends bolt 9 and into which the hook member 6 is inserted in the mounted position. The hook member 6 is snugly received in the holding element 3 so that the hook member 6, if laterally displaced or bent, takes along the holding element 3 and, hence, the front member 1.

In the region of bolt 9, the hook member 6 is provided with an undercut recess 12 which prevents the front member 1 from disengaging unintentionally.

At the top and at the bottom the holding element 3 is provided with inclined inserting surfaces 13, which are triangular when viewed from the top and facilitate insertion of the hook member 6 into the holding element 3.

The clamping screw 7 is provided at the other end of the hook member 6. Clamping screw 7 is mounted in a female thread in the hook member 6 and has a countersunk head 14 which projects into an elongated or oblong hole 15 in the fastening element 5 and rests against an end portion 16 of the rim of oblong hole 15.

Figure 2:
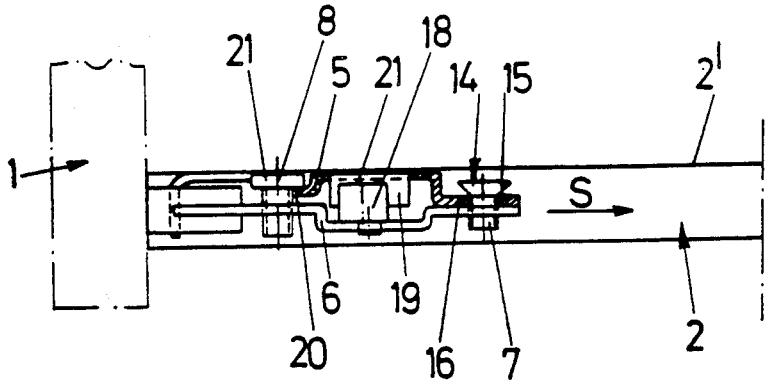
FIG. 2 is a top view of the mounting device for front members according to the invention, parts thereof being shown in section.

When the clamping screw 7 is tightened, the countersunk head 14 shifts or moves over portion 16, such that head 14 and thereby hook member 6 are displaced in the direction of arrow S in FIG. 2, and the holding element 3 engaged in the hook member 6 is pressed against flanges or flaps 17 of the fastening element 5. A clamping arrangement of the parts is thus obtained and an absolutely secure anchoring of the front member 1 to the drawer side wall 2 is guaranteed.

An eccentric 18 which rests against a horizontal flange 19 of the fastening element 4 is mounted on the hook member 6 between the clamping screw 7 and the side adjustment screw 8. Turning of the eccentric 18 effects pivotal movement of the hook member 6 about its bearing at the clamping screw 7.

The head of side adjustment screw 8 is engaged behind a projection 20 of the fastening, and screw 8 is threaded into hook member 6. Thus, rotation of screw 8 causes movement of hook member 6, holding element 3 and front member 1 horizontally, i.e. parallel to the axis of screw 8. A side adjustment screw 8 is provided at the mounting device for the front member at only one side of the drawer. At the other side of the front member 1 the hook member 6 yields resiliently when lateral adjustment is effected.

An internal wall 2' of side wall 2 is provided with perforations 21 which allow access of an adjustment tool, for example of a screw driver, to the mounting device for the front member.

The mounting device for the front member according to the invention allows rapid fastening of the front member 1 and adjustment thereof, and also dismounting of the front member 1 from the drawer side walls 2 at any time.

What is claimed is:

1. A device for mounting a front panel of a drawer, said device comprising:

a holding element fastenable to the front panel;

a fastening element to be fixed to a side wall of the drawer;

a hook member extending substantially perpendicular to the front panel and having a first end including means for engaging said holding element;

means for mounting a second end of said hook member for pivotal movement about an axis extending substantially horizontally and parallel to the front panel, and for selectively shifting said hook member and said holding element relative to said fastening element in a direction perpendicularly of the front panel, thereby clamping the front panel in a mounted position;

means, operable between said fastening element and said hook member, for selectively moving said hook member and said holding element laterally relative to said fastening element, and thereby for adjusting the relative horizontal position of the front panel with respect to the drawer; and means, operable between said fastening element and said hook member, for selectively pivoting said hook member and said holding member about said axis relative to said fastening element, and thereby for adjusting the relative vertical position of the front panel with respect to the drawer.

2. A device as claimed in claim 1, wherein said holding element has therein a vertical slot and a rod extending across said slot, and said means of said first end of said hook member extends into said slot and engages said rod.

3. A device as claimed in claim 2, wherein said means of said first end of said hook member comprises a hook which engages said rod from the bottom thereof, and said hook has an undercut recess to receive and retain said rod.

4. A device as claimed in claim 2, wherein said first end of said hook member fits snugly within said slot.

5. A device as claimed in claim 1, wherein said horizontal adjusting means comprises a side adjustment screw extending parallel to said axis, said side adjustment screw including a portion threaded into said hook member and a portion abutting said fastening element, such that rotation of said side adjustment screw causes movement of said hook member laterally relative to said fastening element.

6. A device as claimed in claim 1, wherein said vertical adjusting means comprises an eccentric rotatably mounted on said hook member and abutting a horizontal abutment of said fastening element, such that rotation of said eccentric causes said hook member to pivot about said axis.

7. A device as claimed in claim 6, wherein said eccentric is positioned between said axis and said horizontal adjusting means.

8. A device as claimed in claim 1, wherein said shifting means comprises a clamping screw threaded into said second end of said hook member and extending through an elongated hole in said fastening element, said clamping screw having an inclined countersunk head engaging a portion of the rim of said hole, such that tightening of said clamping screw causes said inclined head to move along said rim portion, thereby shifting said clamping screw and said hook member in said direction.

9. A device as claimed in claim 1, wherein said fastening element includes flanges extending parallel to the front panel and against which said holding element abuts.

10. A device as claimed in claim 1, wherein said fastening element is welded to the drawer side wall.

* * * * *